United States Patent [19]

Utterback

[11] Patent Number: 4,861,461

[45] Date of Patent: Aug. 29, 1989

[54] PIPELINE PADDING MACHINE AND METHOD

[76] Inventor: Eugene C. Utterback, 484 W. Remus Rd., Mt. Pleasant, Mich. 48858

[21] Appl. No.: 59,491

[22] Filed: Jun. 8, 1987

[51] Int. Cl.[4] ..... E02F 5/22

[52] U.S. Cl. ..... 209/234; 37/142.5; 209/241; 209/247; 209/257; 209/420

[58] Field of Search ..... 37/142.5, 195; 405/179; 209/421, 420, 234

[56] References Cited

U.S. PATENT DOCUMENTS

| | | | |
|---|---|---|---|
| 2,947,096 | 8/1960 | Cummings et al. | 37/142.5 |
| 3,402,816 | 9/1968 | Taylor | 209/421 X |
| 3,701,422 | 10/1972 | Downey | 37/142.5 X |
| 4,591,432 | 5/1986 | Martl | 209/421 X |
| 4,633,602 | 1/1987 | Layh et al. | 37/142.5 X |
| 4,664,791 | 5/1987 | McClain et al. | 37/142.5 X |

FOREIGN PATENT DOCUMENTS

| | | | |
|---|---|---|---|
| 1480688 | 7/1977 | United Kingdom | 209/420 |

*Primary Examiner*—Clifford D. Crowder
*Attorney, Agent, or Firm*—Learman & McCulloch

[57] ABSTRACT

A pipeline padding vehicle for supplying earth of a fine consistency to cover and pad a pipeline disposed in a trench has a longitudinal conveyor, a vibrating screen to receive earth from the conveyor, and a padding material discharge conveyor beneath the screen to receive material therefrom mounted to pivot about a vertical axis from a position in which it is longitudinally aligned with the vehicle frame to a position transverse of the frame. A sub-frame mounts the vibrating screen and discharge conveyor on the vehicle for fore and aft swinging movement about a generally horizontal axis transverse to the longitudinal extent of the vehicle frame.

32 Claims, 5 Drawing Sheets

PIPELINE PADDING MACHINE AND METHOD

BACKGROUND OF THE INVENTION

Subterranean cross country pipelines designed to carry such fluids as water, gas and oil, for example, today are commonly installed at a predetermined level beneath the surface of the ground in trenches, which are back filled after the pipe sections are secured in end-to-end continuity. Such pipe sections often are made from fairly brittle material coated with a corrosion-resistant substance. To preserve the integrity of the pipeline and prevent rupture of the coating, relative fine soil particles frequently are introduced into the trench to serve as a protective padding around the pipeline before the backfilling takes place with heavier material.

The subsoil removed during the trenching operation normally contains large and heavy stones and rocks and some large chunks of clay and earth, as well as earth of a reasonably fine consistency which itself can be utilized as the padding material While a number of padding machines and methods have been proposed, such as those disclosed in U.S. Pat. Nos. 2,947,096; 3,701,422; 4,057,917; and 4,377,365, none appears to have been sufficiently practical to find widespread adoption. Such a vehicle, to be effective commercially, must be capable of separating the fine earth, or suitable padding material, from the excavated subsoil and delivering it to the trench as the vehicle moves along the trench, and yet the components of the machine must be adjustable so that it can be moved along a highway from job location to job location.

SUMMARY OF THE INVENTION

The present invention is concerned with certain improvements in padding separating and delivery systems, wherein the vehicles used fall within the statutory size limits regulating vehicle transport along the nation's roads and highways. The padding separating and delivering vehicle is designed to be readily convertible from a compact body, which is within the legal width dimension for roadway travel, to effective operating position for travel along a pipeline trench to effect continuous depositing of padding material in the volume required. Further, the machine must be operative in uneven or hilly terrain where the vehicle may be required to operate in an attitude of vertical inclination.

One of the prime objects of the present invention is to provide improved apparatus and methods for continuously separating the large stones and hard chunks normally found in native earth material from finer material, and then delivering the finer material to a deposit location laterally spaced from the line of the travel of the vehicle, while delivering the larger material to a deposit location laterally removed from the location of the fines deposit.

Another object of the invention is to provide apparatus of this character which is constructed in a manner such as to be contractible for travel along existing roadways.

Still another object of the invention is to design a system utilizing a vibratable screen deck, with an accompanying fines discharge conveyor and heavy material discharge conveyor, which can be turned crosswise in the vehicle frame, while at the same time being mounted for vertical tilting movement to a level position most efficiently to receive material from a supply conveyor longitudinally aligned with the vehicle.

A further object of the invention is to supply a vehicle of the character described for continuously processing excavated material, and continuously conveying padding material either to the trench, or a position directly alongside the trench, in a most expeditious and controlled manner.

Another object of the invention is to provide a practical and reliable system and method operable in various areas of the country having difficult terrain.

Still a further object of the invention is to provide a machine of the nature specified which can be manufactured and marketed economically, and which, in a very short time, can pay for itself in terms of the economies of operation which it effects.

Other objects and advantages of the invention will be pointed out specifically or will become apparent from the following description when it is considered in conjunction with the appended claims and the accompanying drawings.

GENERAL DESCRIPTION

Figure 1:
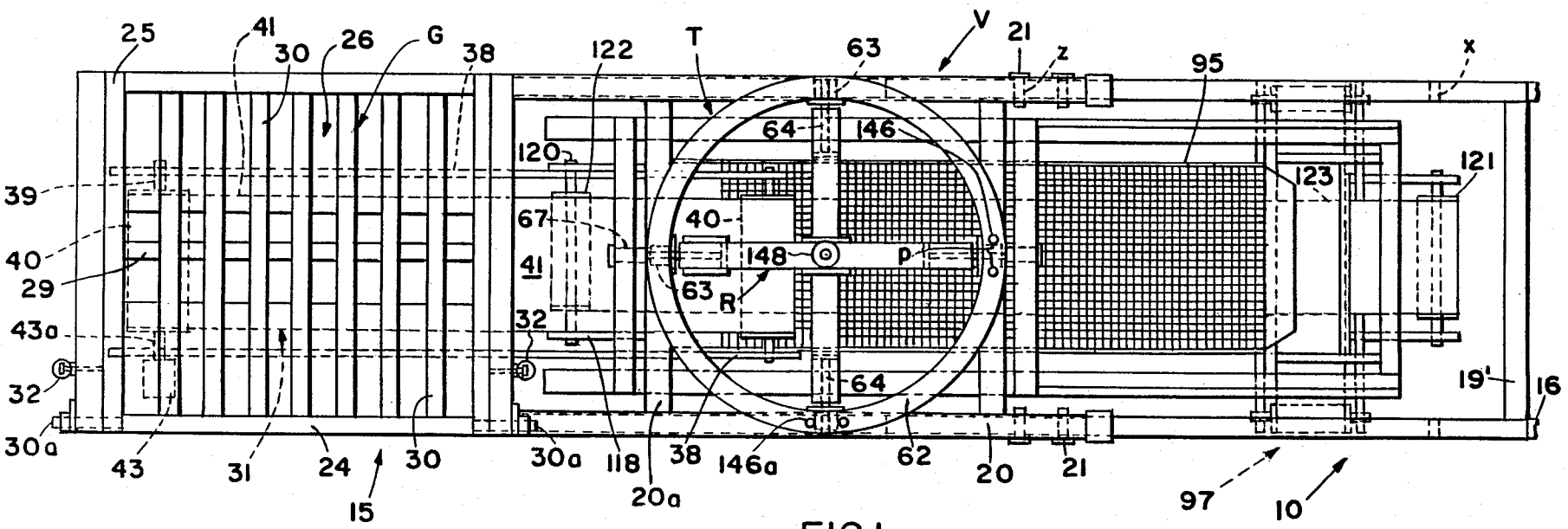
FIG. 1 is a top plan view showing the separating and padding machine in laterally contracted condition, suitable for being transported on a modern highway.

Referring now more particularly to the accompanying drawings, the letter V generally indicates a vehicle embodying the inventive apparatus which will now be more particularly described, and which is shown as comprising a frame generally designated F which includes a front frame section generally designated 10 adapted for coupling to a towing vehicle (not shown). When being drawn from job location to job location along a roadway, the frame section 10 can be coupled to a towing vehicle, such as a truck tractor. When in use and being drawn along a pipeline trench, the frame section 10 can be coupled to a rough terrain vehicle such as a tractor having endless treads. The vehicle frame F is supported via a suitable suspension system, including members 11 (FIG. 4), by front wheels 12 and rear wheels 13. As FIG. 4 particularly indicates, frame F also includes a front section 14 and a rear section 15. If desired, the vehicle V may be self-propelled and include a suitable engine for driving either the wheels 12 or 13.

The front section 10 may be a fabrication which includes side sections made up of members 16, 17 and 18, which are joined at their upper ends to longitudinal beams 20' spanned by a cross beam 19'. The beams 20' are telescopically received in longitudinal side beams 20 which join telescopic front section 10 to the rear frame section 15, and cross members **20*a* preferably span the beams 20 as indicated. Openings x provided in the beams 20'** may register with openings y provided in the beams 20 to permit pins 21 to be inserted and maintain the front frame section 10 in the FIG. 2 position. Openings z provided in the frame 20 permit pins 21 to be inserted through the openings z and y to maintain the front frame section 10 in the FIG. 1 position.

Figure 2:
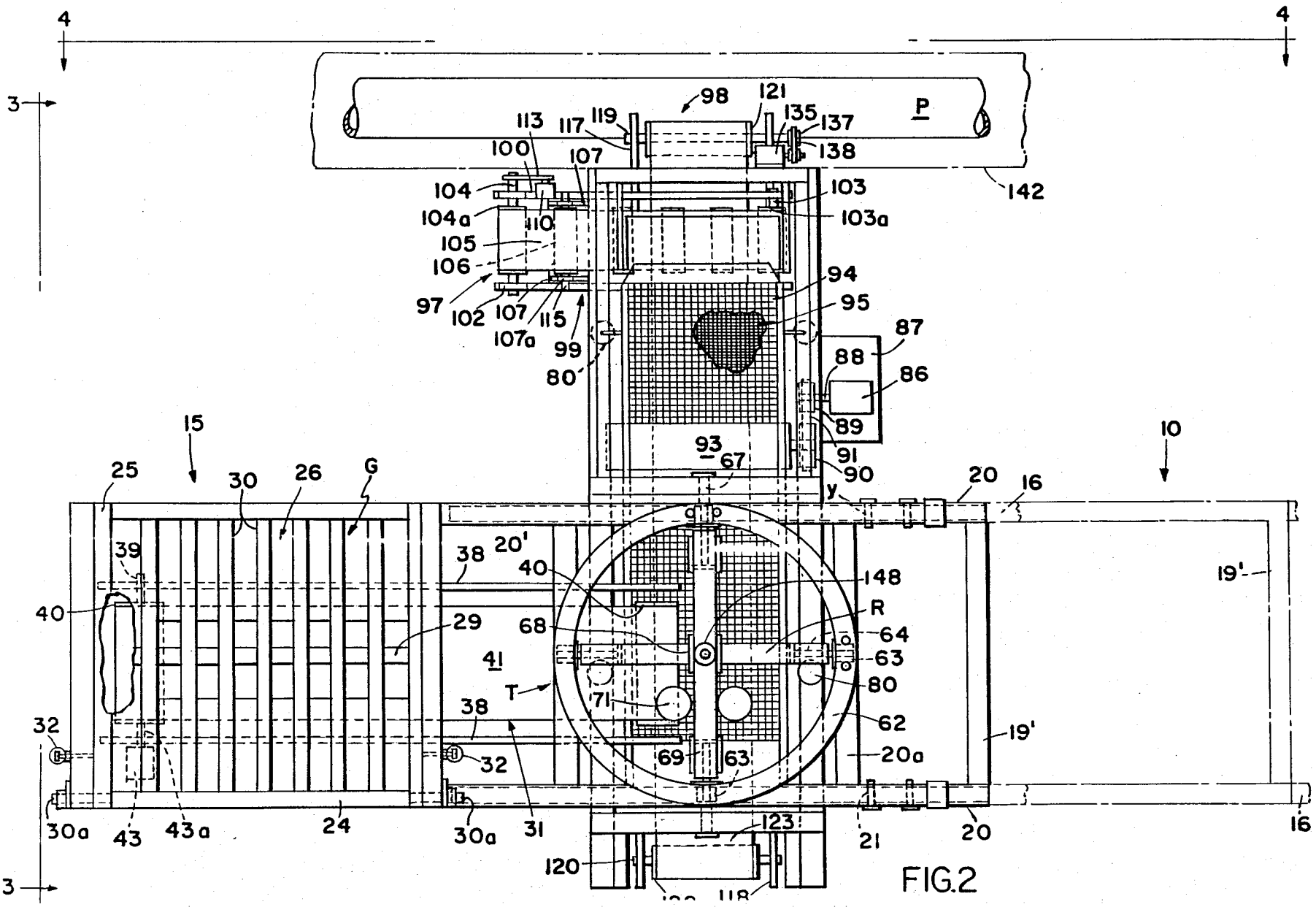
FIG. 2 is a similar top plan view, showing the machine in a laterally expanded position, and set up to move along a pipeline trench and deliver padding material thereto.
Figure 4:
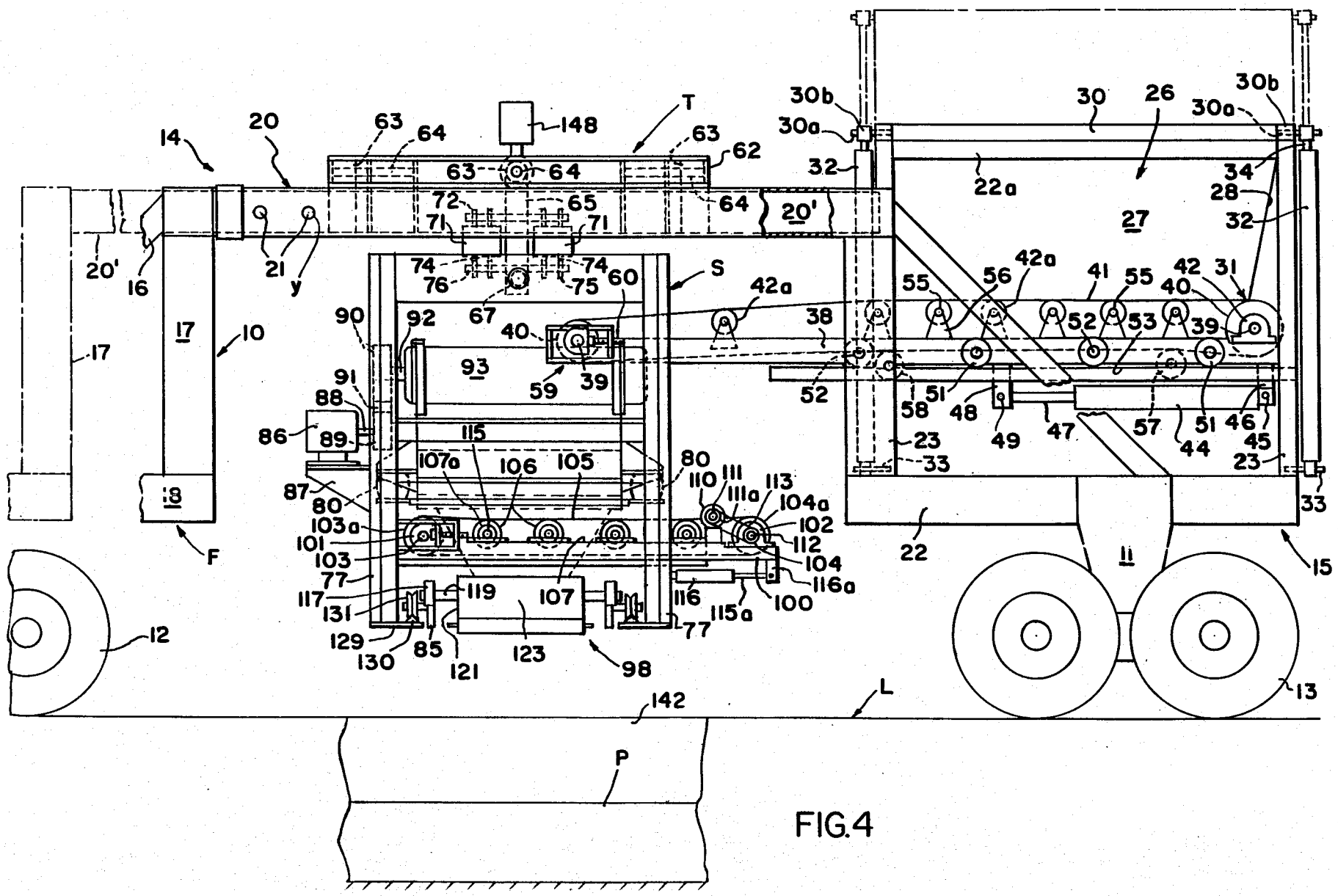
FIG. 4 is a side elevational view taken on the line 4—4 of FIG. 2.

As FIGS. 2 and 4 particularly indicate, frame section 15 includes a lower box frame 22 with longitudinal and transverse members 22*a*, connected with upright beams 23 at each of its four corners. Fixed thereto are the longitudinal members 24 and transverse members 25, which form the open upper end of a hopper, generally designated 26, and which have hopper side and end walls 27 and 28, respectively. A grate, generally designated G, made up of longitudinal members 29 and cross members 30 covers the top of the hopper 26, which overlies a longitudinally disposed, endless conveyor, generally designated 31. Grate G preferably is pivotally mounted at one side on longitudinally projecting shaft ends 30*a* received in bearings 30*b* on Frame F.

The hopper 26 comprises means to accommodate a mixture of relatively coarse and relatively fine materials such as that excavated from a trench in which a pipeline is to be laid.

A bucket crane or power shovel (not shown) may be used to supply material which has been dug from the trench and piled alongside the trench to the grate and hopper. Large stones, rocks, and hard clods of clay will be trapped by the grate G, while finer earth material falls through the grate G to the longitudinal conveyor 31. Hydraulic cylinders 32, connected to the upright beams 23 at their lower ends near one side of the vehicle, as by pins 30, have their piston rods 34 connected to the endmost bars 30 of the grate G near the one side of the vehicle, and are capable of raising the one side of the grate G to a vertically tilted position as indicated by the chain lines in FIG. 4, to periodically discharge heavy material trapped by the grate G over one side of the vehicle. Alternatively, one of the longitudinal side beams 29 of the grate G may have bearing supported shaft ends which are power driven to pivot the grate G to a near vertical position suitable to discharge the material trapped over the side of the vehicle.

Figure 5:
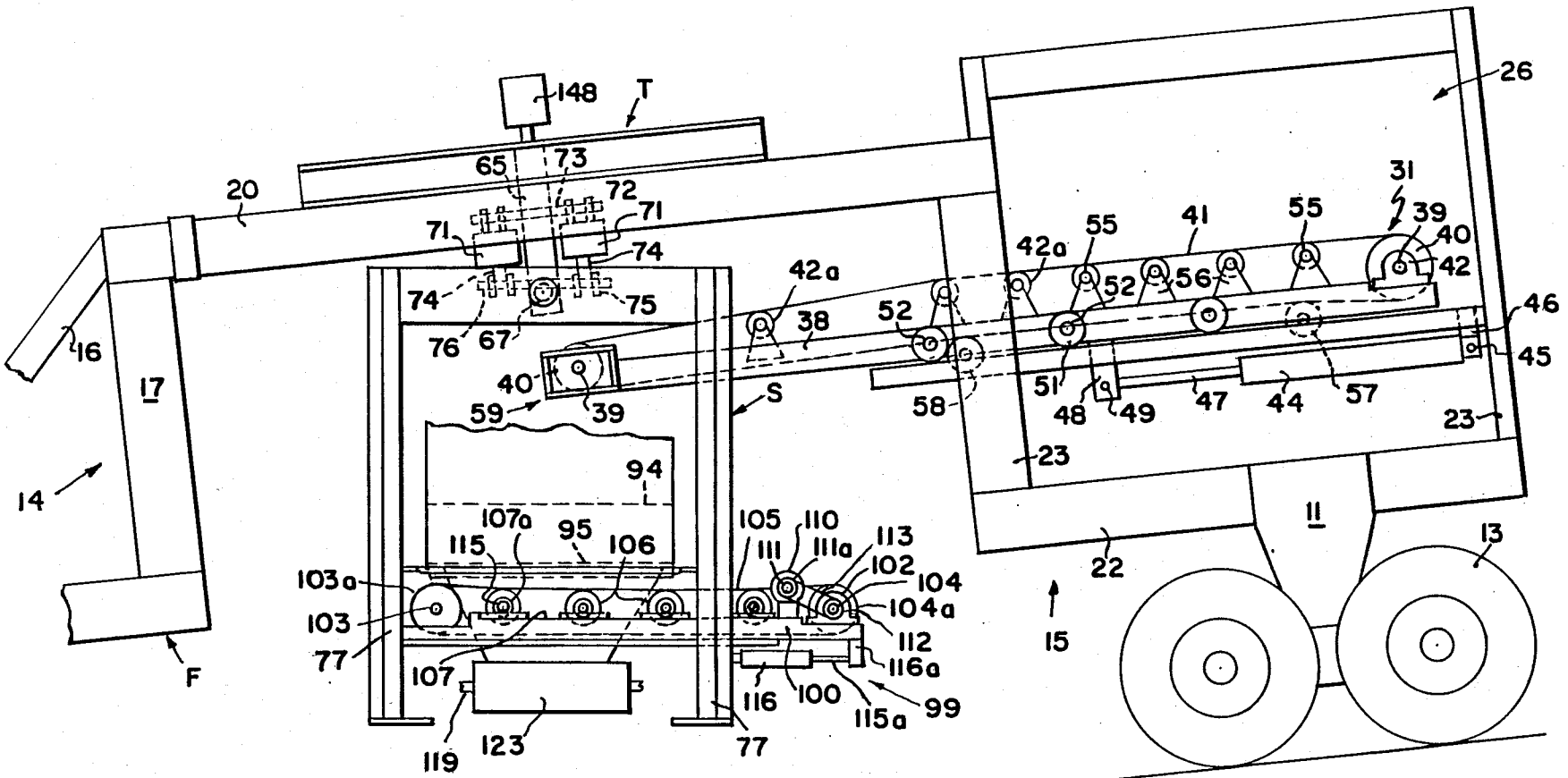
FIG. 5 is a fragmentary, diagrammatic elevational view similar to FIG. 4, but showing the apparatus in use on an incline.

As FIGS. 2, 4 and 5 particularly indicate, the longitudinal conveyor 31 may include conveying frame side beam members 38. At their opposite ends beams 38 journal the shaft ends 39 of end rollers 40, and a suitably rugged endless belt 41 is trained around the rollers 40. In addition, idler rollers 42*a* are mounted by the frame to aid in supporting the endless belt 41. The shaft ends 39 are supported in bearings 42, and a hydraulically powered rotary motor 43 can be mounted by the side beams 38, to have an output shaft 43*a* connected to one of the rear roller shaft ends 39 to power the belt 41.

As FIG. 5 indicates, hydraulic cylinders 44 connected at their rear ends as at 45 to frame mounted brackets 46 can be utilized to move the longitudinal conveyor 31 lengthwise forwardly and rearwardly. Hydraulic cylinders 44 are shown as having piston rods 47 pinned to brackets 48 as at 49, which connect to the beams 38. For purposes hereinafter to be explained, the conveyor 31 can then be shifted longitudinally on rollers 51 mounted on shafts 52 fixed to the side rails 38. The rollers 51 travel along track support surfaces 53 supported by the frame section 15.

To support the upper run of conveyor belt 41, rollers 54 are rotatably mounted on pins 55 secured to pedestals 56 on the conveyor side plates 38. Further, idler rolls 57 and 58 are provided on the beams 38 to support the lower run of the belt 41. The usual adjustable bearings 59 for supporting the rollers 40 at each side each preferably includes a threaded member 60 adjustably supporting the rolls for lengthwise adjustment to secure the proper tension in belt 41.

Figure 3:
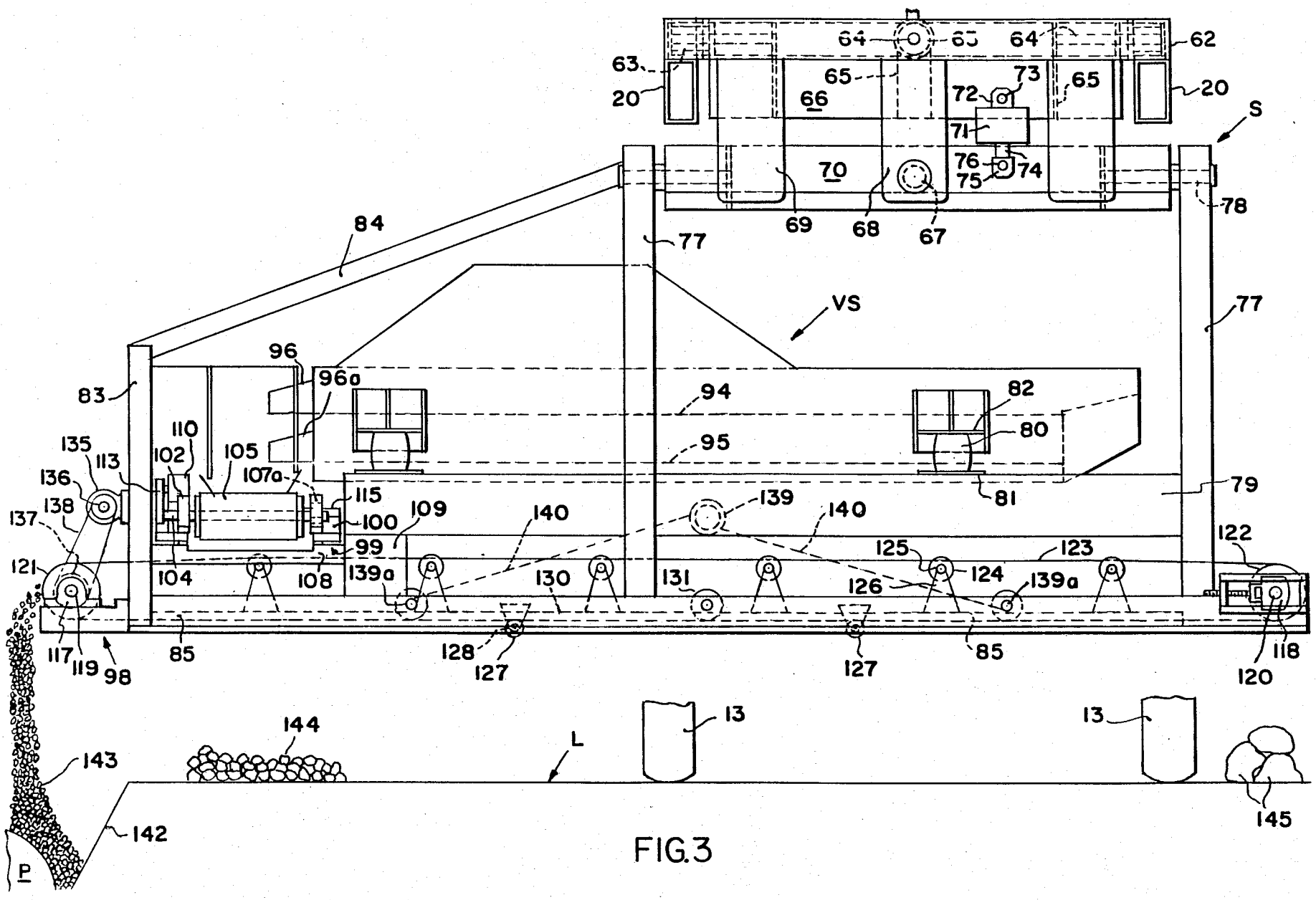
FIG. 3 is an end elevational view taken on the line 3—3 of FIG. 2.

As FIGS. 1, 3 and 4 particularly indicate, the longitudinal beams 20 support a turntable, generally designated T, between the front frame section 14 and the rear frame section 15. Suspended from the rotary cruciate frame R of the turntable T is a separating system sub-frame, generally designated S, which is movable thereon through a 90° arc of generally horizontal travel to move sub-frame S and the elements it supports from the FIG. 1 travel position, to the FIG. 2 operative position.

As FIGS. 2–4 indicate, the turntable T may comprise a channel-shaped circular track member 62 within which rollers 63 on shafts 64 are rotatably received. The shafts 64 are fixed to beams 65 welded to the frame R cross beams 66. The sub-frame S is pivotally mounted on pins 67 for longitudinal, fore and aft pivoting movement relative to revolving frame R, pin 67 being mounted on oppositely disposed hanger straps 68 fixed to the beams. Plates 69 also depend from the turntable structure to function as guides for the beams 70 which comprise the upper portion of sub-frame S. Position-maintaining hydraulic cylinders 71 having straps 72 pinned at 73 to the beam structure 66, as shown in FIG. 3, include piston rods 74 with clevis ends 75 which are pinned as at 76 to the beam structure 70.

The sub-frame S further includes upright support beams 77 fixed to the upper beam structure 70, as with pins 78, and connected at their lower ends by beams 79. The beams 79 form a support platform for a conventional two-deck vibrating conveyor, generally designated VS, which, as FIG. 3 indicates, is supported from the platform structure 79 on rubber springs 80. Rubber springs 80 are supported between plates 81 provided on the platform structure 79, and fittings 82 provided on the vibrating conveyor VS, which may, for example, be of the general character described in U.S. Pat. No. 3,491,888. Sub-frame S further has upright beams 83 at one end connected to beams 77 by members 84, and it will be noted that conveyor support beams 85 span and are rigidly fixed to beams 83 and 77 at their lower ends. A motor 86 supported on a motor mount 87 fixed to one of the members 77 has an output shaft 88 with a sheave 89 connected with a vibrating shaft sheave 90 by a suitable belt drive 91. Sheave 90 may be provided on one of the shaft ends 92 which supports the usual eccentric shaft 93 for causing the deck structure of the conveyor VS to vibrate.

The upper screen of the two-deck vibrating structure is shown at 94 in FIG. 2, and the lower screen at 95. When material is deposited upon the upper screen 94 by the conveyor 31 material which is retained by the upper screen 94 passes via an apron 96 or trough to an oversized material or tailings discharge conveyor, generally designated 97. Material retained on screen 95 also is discharged to the tailings conveyor 97 via a similar apron 96*a*. Tailings conveyor 97 comprises a retractable frame or carriage, generally designated 99, which includes beams 100 provided with bearings 101 and 102 at their opposite ends for supporting conveyor shafts 103 and 104. The shafts 103 and 104 support conveyor end rollers 103*a* and 104*a* around which an endless discharge belt 105 is trained. Intermediate idler rollers 106 are rotatably supported on the shaft 115, fixed to the carriage beams 100. Tailings conveyor 97 also includes carriage support rollers 107*a* which roll along tracks 107, provided on a conveyor understructure 108 which is fixed to beams 77 and to supports 109. As FIG. 2 indicates, roller 104*a* may be driven by a suitable motor 110 via an output shaft 111, with a sheave 111*a* thereon driving a roller shaft drive sheave 112 via a belt 113. The hydraulic cylinder 116, fixed to the sub-frame structure S, has a piston rod 115*a* connected with a member 116*a* spanning the beams 100 to move the tailings conveyor 97 in extending and retracting movement relative to sub-frame structure S.

As FIGS. 3 and 4 particularly indicate, the padding material discharge conveyor 98, which receives the relatively fine material which passes through both the superposed screens 94 and 95, includes bearing members 117 and 118 for the shafts 119 and 120 which mount the conveyor end rolls 121 and 122 around which endless conveyor belt 123 is trained. The upper run of the belt 123, as shown in FIG. 3, is supported by idler rollers 124 provided on shafts 125 on standards 126 fixed to the conveyor side frame members 85. Similarly, idler rollers 127, fixed on shafts 128, mounted on the beams 85, can be provided for the lower run of conveyor belt 123.

As FIG. 4 indicates, the sub-frame S has inwardly extending plates 129 with tracks 130 thereon supporting the rear side frames 85 on which rollers 131 mount for extending and retracting movement relative to sub-frame S. Conveyor belt 123 may be driven via a motor 135 (see FIG. 3) by an output shaft 136 connected with a sheave 137 on shaft 119 by a belt 138. Winch 139, run by a suitable electrically powered motor, can be connected to shafts 139*a* by lines 140 to move the conveyor frame members 85 on tracks 130 via rotation of the winch in one direction or the other.

In FIGS. 3 and 4, ground level is indicated at L, and a trench 142 is shown as having been dug therein. The pipeline, generally designated P, is shown disposed in the trench 142, and padding discharge conveyor 98 is shown as depositing the fine padding material 143 in place thereon. The coarser material which will be useful in filling the trench 142 once the padding material 143 is in position, is shown as having been discharged by the discharge conveyor 97 in a pile extending along the trench 142 at 144. The rocks and stones, which previously have been discharged by the grate G, are shown at 145 after having been moved off the grate G by the force of gravity

THE OPERATION

In FIG. 1, the various components are shown in a highway transport position, in which the vehicle is compacted to conform to the legal width and length requirements for roadway transport, so that it can be transported along a roadway by a suitable highway vehicle to the job location. To ready the system for operation, the front frame 10 is unhooked from the highway transport vehicle and connected to a suitable bulldozer or tractor which moves it into position alongside trench 142, as shown in FIG. 3.

The first step in the operation involves actuation of the cylinder 44 to move the longitudinal conveyor 31 rearwardly until its front end has longitudinally cleared the revolving frame R and sub-frame S. The vertically disposed pins p which are extended through the openings 146 in turntable track 62 down into openings (not shown) in the sub-frame cross members 70 are lifted to clear the turntable revolving assembly R, and the motor 148 which drives the turntable beam structure R is activated to swing the turntable structure R 90° from the FIG. 1 position to dispose the underlying sub-frame S in a crosswise position to the main frame beams 20, as disclosed in FIG. 3. Pins p can then be reinserted through the openings 146*a* in turntable track 62 to again trap one of the rollers 63 and anchor the turntable structure R in this adjusted position. The pins 21 may then be removed from the openings z provided in the telescopic beams 20' and the openings y in the frame beams 20 to permit inward telescoping movement of the front frame section 10 to the FIG. 2 position, whence pins 21 are then reinserted through the openings x and main frame beam openings y.

Hydraulic cylinder 44 is extended to position the discharge end of conveyor 31 centrally with respect to the upper screen 94 so that material discharged by conveyor 31 will be deposited centrally on the now transversely disposed screen 94. If the terrain on which the vehicle rests is inclined, as illustrated in FIG. 5, one of the hydraulic cylinders 71 may be retracted and the other extended to dispose the sub-frame S in a level or horizontal state out of parallel with the inclined main frame and beams 20.

Tilting, or swinging of the sub-frame causes corresponding fore and aft of the vehicle frame movement of the screen 94, thereby varying its position relative to the discharge end of the conveyor 31. It is desirable that the material discharged from the conveyor 31 fall onto the center of the screen 94. This objective can be ensured by adjustment of the cylinders 44. Thus, regardless of the inclination of the ground over which the vehicle is traveling along trench 142 (within reasonable limits), the cylinders 71 and 44 can maintain the screens 94 and 95 level and the conveyor 31 discharging its contents centrally of the screen 94.

Once the sub-frame structure S is swung to operating position and locked by the pins p, tailings conveyor 97 is then moved outwardly from the retracted position in which it is shown in FIG. 1 to the extended position in which it is shown in FIG. 2. In addition, the position of the padding discharge conveyor 98 is under the control of the operator via winch 139 and it is positioned by the operator to discharge centrally into the trench 142 in the manner indicated in FIG. 3.

Initially a power shovel, or the like, is employed to load material onto the grate G at the rear end of the vehicle. Large rocks, stones, and clods will remain on the grate G while the remaining material passes through to the hopper 28. Periodically the cylinder 32 can be actuated to raise the grate G about its pivots 30*a* and discharge the material collected on the grate G in a pile 145. Material discharged by the hopper 28 to the conveyor belt 41 which underlies it proceeds at a predetermined speed for discharge to the vibrating conveyor VS, where, as indicated, it can be discharged centrally to the screen 94 regardless of the angle of inclination of the vehicle and the tilted position of the sub-frame S.

Because material is delivered to the conveyor 31 from a hopper, and because such material is delivered to a vibrating structure VS employing two screens, flooding of the vibrating structure with material tends to be avoided, and a greater efficiency achieved. Moreover, because the hydraulic rotary motor 43 provides an infinitely adjustable speed, the amount of material discharged from conveyor 31 can be precisely controlled.

Larger sized stones and other material screened out by the screens 94 and 95 proceeds to the tailings conveyor 97 as indicated, as the vehicle moves along the trench 142, and discharges in a pile 144. The desired fines which have been separated, are discharged to the trench to form a pad 143 that covers the pipeline P in a continuous manner, the speed of advance of the vehicle and padding discharge conveyor 98 being regulated with respect to the amount of fines being discharged by conveyor 98. Later, the material 144 can be pushed into the trench 142 by a bulldozer or other suitable machine.

If desired, the apparatus can be used to provide an under padding layer in trench 142, prior to the time the pipeline is laid, and then later used in another pass along the trench line 142 to deposit an overpadding. For highway travel the components are returned to the FIG. 1 position.

Although one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

WHAT IS CLAIMED IS:

1. In a pipeline padding supplying system for supplying earth of a fine consistency to cover and pad a pipeline disposed in a trench, the combination comprising:

a. a vehicle frame supported for travel longitudinally along a highway, or alternately along a trench;

b. hopper means into which raw earth, containing large chunks and rocks, is supplied at one end of the frame;

c. a longitudinally disposed conveyor, having an end disposed beneath said hopper means to receive earth from the hopper and convey said earth longitudinally toward the opposite end of the frame;

d. vibrating screen means mounted on said frame to receive earth from the opposite end of said conveyor;

e. a cross conveyor mounted by said frame beneath said vibrating screen means for pivotal movement about a vertical axis from a position in which it is longitudinally aligned with said vehicle frame and longitudinally disposed conveyor for transport therewith when the vehicle frame is moving from one job location to another to a position crosswise to said frame and longitudinally disposed conveyor, said crosswise conveyor being of a length to have one end disposed beneath the vibrating screen means to receive screened earth therefrom and another discharge end projecting out over said trench to deliver screened earth thereto as the vehicle is moved longitudinally along said trench; and f. a tailings conveyor associated with said vibrating screen means to receive material screened out by said vibrating screen means, and having a discharge end located at a spaced distance from said discharge end of the cross conveyor to discharge the tailings remotely from the screened earth.

2. The invention defined in claim 1 wherein said cross conveyor has a motor-driven conveying surface, and means is provided for moving said vehicle frame along said trench at a predetermined speed relative to the speed of travel of said cross conveyor conveying surface.

3. The invention defined in claim 1 wherein a sub-frame mounts said vibrating screen means and cross conveyor on said vehicle frame for pivotal movement about a generally horizontal axis transverse to the longitudinal extent of the vehicle frame.

4. The invention defined in claim 3 wherein a turntable on said vehicle frame also mounts said sub-frame for pivotal movement about a vertical axis.

5. The invention defined in claim 4 wherein means is provided for anchoring said turntable in vertically pivoted position.

6. The invention defined in claim 3 wherein motor means is provided on said vehicle frame for moving the sub-frame to a pivoted position about said horizontal axis to level the vibrating screen means with respect to the discharge end of the longitudinally disposed conveyor when the vehicle frame is in longitudinally vertically sloped disposition.

7. The invention defined in claim 6 wherein said sub-frame has track means extending generally perpendicular to the track means for supporting said cross conveyor and said tailings conveyor is mounted for extending and retracting movement therealong.

8. The invention defined in claim 6 wherein said longitudinally disposed conveyor is mounted on longitudinal track means, and motor means is provided for positioning it with respect to the center of said vibrating screen means.

9. The invention defined in claim 3 wherein tracks are provided on said sub-frame, and said cross conveyor is mounted for extending and retracting travel on said tracks.

10. The invention defined in claim 1 wherein a pivotal grate is provided as a top for said hopper means; means mounts said grate for pivotal movement about a generally horizontal axis to and from a generally vertically disposed dumping position; and motor means is provided to power said grate.

11. The invention defined in claim 1 wherein said tailings conveyor is mounted for travel crosswise to said crosswise conveyor in longitudinal parallelism with said longitudinally disposed conveyor.

12. In a pipeline padding system for supplying earth of a fine consistency to a pipeline trench, the combination comprising:

a. a longitudinally extending vehicle frame supported for travel longitudinally along a highway, or alternately along a trench;

b. a first conveyor for conveying earth material along the vehicle frame;

c. a sub-frame mounted on said vehicle frame for pivotal movement about a generally horizontal axis transverse to the longitudinal extent of the vehicle frame;

d. vibrating screen means mounted on said sub-frame below the level of said first conveyor to receive earth material therefrom;

e. a padding material discharge conveyor mounted by said sub-frame beneath said vibrating means, said discharge conveyor being of a length to have one end disposed beneath the vibrating screen means to receive screened earth material therefrom and a discharge end projecting out over said trench to discharge said screened earth material thereto as the vehicle is moving continuously along the trench;

f. means for discharging oversized material separated out by said vibrating screen means at a position remote from the discharge end of the discharge conveyor; and g. means mounting said discharge conveyor for movements from a first position in which it extends longitudinally of said frame to a second position in which it extends crosswise of said frame.

13. The invention defined in claim 12 wherein said discharge conveyor is mounted on said vehicle frame for pivotal movement about a generally vertical axis relative to the vehicle frame and to said first conveyor.

14. A method of supplying earth of a fine consistency to an open pipeline trench to function as padding material for the pipeline wherein a vehicle frame is positioned opposite the trench for travel longitudinally parallel to the trench; a first conveyor is provided on the vehicle for receiving natural earth; a vibrating screen is mounted on the frame to receive earth from the conveyor; a second cross conveyor, having a powered conveying surface, is mounted by the frame beneath the vibrating screen for pivotal movement about a vertical axis from a position in which it is lengthwisely aligned with the vehicle frame for transport therewith, when the vehicle frame is moving from one job site to another, to a position crosswise to said frame; and a tailings conveyor is associated with the vibrating screen to receive oversized material screened out by the vibrating screen: the steps of a. pivoting the cross conveyor from a position of longitudinal alignment with the vehicle frame about a generally vertical axis to a position transverse thereto in which the discharge end of the cross conveyor overlies the trench and discharges thereto;

b. supplying natural earth to said first conveyor;

c. receiving the natural earth from said first conveyor and vibrating said screen to separate the oversized material from the fines, while discharging the fines to the cross conveyor;

d. conveying the fines on the cross conveyor and discharging them to the trench to form a pipe pack; and e. moving the vehicle frame along the trench at a predetermined speed coordinated with the speed of travel of the fines material on the cross conveyor conveying surface.

15. The method of claim 14 including the step of tilting the vibrating screen and cross conveyor about a generally horizontal axis to a level position to permit the said first conveyor to discharge centrally to the vibrating screen when the vehicle is in a state of vertical inclination.

16. In a pipeline padding supplying system for supplying earth of a fine consistency to a pipeline trench, the combination comprising:

a. a longitudinally extending vehicle frame supported for travel longitudinally along a highway, or alternately along a trench;

b. a first longitudinally disposed conveyor for conveying earth material along the vehicle frame;

c. vibrating screen conveyor means mounted on said frame below the level of said first conveyor to receive earth material therefrom;

d. a second, padding material delivery conveyor mounted by said frame crosswise to said first conveyor beneath said vibrating screen means, said delivery conveyor being of a length to have one end disposed beneath the vibrating screen means to receive screened earth therefrom and another discharge end projecting out over said trench to deliver said screened earth thereto as the vehicle is moving continuously along the trench; and e. a third conveyor, extending longitudinally generally parallel to said first conveyor and trench, having an end disposed beneath said vibrating screen conveyor means for receiving oversized material separated out by said vibrating screen conveyor means at a position adjacent said trench spaced from the discharge end of said second delivery conveyor.

17. The invention defined in claim 16 wherein means mounts said vibrating screen conveyor means and delivery conveyor on said vehicle frame for pivotal movement relative to the longitudinal extent of the vehicle frame about a generally vertical axis.

18. Pipeline padding apparatus comprising supporting frame means movable in a direction longitudinally of a trench in which a pipeline is adapted to be laid; means carried by said frame means for accommodating a mixture of relatively fine and relatively coarse earth constituents; separator means mounted on said frame means for separating said relatively fine and relatively coarse constituents; delivery means for delivering said constituents from said accommodating means to said separator means; first means carried by said frame means for discharging said relatively fine constituents from said separator means to a zone in connection with said trench to provide padding for said pipeline; second means carried by said frame means for discharging said relatively coarse constituents from said separator means at a zone remote from that at which said relatively fine constituents are discharged; and means mounting said first and second means for movements relative to said frame and said delivery means from a position in which said first and second means extend longitudinally of said frame to a position in which said first and second means extend crosswise of said frame means.

19. Apparatus according to claim 18 wherein said separator means is mounted on said frame means for tilting movements about a substantially horizontal axis relative to said frame means.

20. Apparatus according to claim 19 wherein said axis is transverse to the direction of movement of said frame means.

21. Apparatus according to claim 19 wherein said first and second means are mounted on said separator means for tilting movements therewith.

22. Apparatus according to claim 18 wherein said separator means is mounted on said frame means for rotation about a substantially vertical axis relative to said frame means.

23. Apparatus according to claim 22 wherein said first and second means are mounted on said separator means for rotation therewith.

24. Apparatus according to claim 18 including means for adjusting said delivery means relative to said frame means to enable the mixture to be discharged from said delivery means at a selected zone of said separator means.

25. Pipeline padding apparatus comprising longitudinally extending, supporting frame means movable in a direction longitudinally of a trench in which a pipeline is adapted to be laid; means carried by said frame for accommodating a mixture of relatively coarse and relatively fine earth constituents; separator means for separating said relatively fine and relatively coarse constituents; means mounting said separator means on said frame means for movements fore and aft longitudinally of said frame means; delivery means for delivering said mixture from said mixture accommodating means to said separator means; means for adjusting said delivery means relative to said frame means for enabling the mixture to be discharged from said delivery means to a selected zone of said separator means in any fore and aft adjusted position thereof; first means carried by said frame means for receiving said relatively fine constituents from said separator means and discharging them to a zone in communication with said trench to provide padding for said pipeline; and second means carried by said frame means for receiving said relatively coarse constituents from said separator means and discharging them to a zone other than that to which said relatively fine constituents are discharged.

26. Apparatus according to claim 25 wherein said first and second means are carried by said separator means for movements therewith.

27. Apparatus according to claim 25 wherein said separator means is mounted on said frame means for rotation about a substantially vertical axis relative to said frame means and said delivery means.

28. Apparatus according to claim 27 wherein said first and second means are carried by said separator means for rotation therewith.

29. Apparatus according to claim 25 wherein said first means comprises a first conveyor and said second means comprises a second conveyor, and means for driving said first and second conveyors.

30. Apparatus according to claim 29 wherein said first and second conveyors are driven in different directions.

31. Apparatus according to claim 29 wherein said first and second conveyors are driven in the same direction.

32. Apparatus according to claim 31 wherein said second conveyor has a length different from that of the first conveyor.

* * * * *